US006988568B2

(12) United States Patent
Buckner

(10) Patent No.: US 6,988,568 B2
(45) Date of Patent: Jan. 24, 2006

(54) VACUUM BORING AND MUD RECOVERY SYSTEM

(76) Inventor: Lynn Allan Buckner, P.O. Box 609, Chickamauga, GA (US) 30707

( * ) Notice: Subject to any disclaimer, the term of this patent is extended or adjusted under 35 U.S.C. 154(b) by 0 days.

(21) Appl. No.: 10/217,055

(22) Filed: Aug. 12, 2002

(65) Prior Publication Data

US 2002/0189139 A1 Dec. 19, 2002

Related U.S. Application Data

(63) Continuation-in-part of application No. 09/722,797, filed on Nov. 27, 2000, now Pat. No. 6,453,584.

(60) Provisional application No. 60/363,058, filed on Mar. 11, 2002, and provisional application No. 60/384,719, filed on Jun. 3, 2002.

(51) Int. Cl.
*E21B 7/18* (2006.01)
*E21B 43/114* (2006.01)

(52) U.S. Cl. ..... 175/67; 210/787; 210/295; 210/360.1

(58) Field of Classification Search ..... 37/323, 37/330, 331; 175/67, 66, 42, 324; 220/212, 220/231; 210/406–415, 767, 200, 787, 799, 210/295, 294, 314–320, 348, 360.1; 299/10, 299/16, 17; 494/37

See application file for complete search history.

(56) References Cited

U.S. PATENT DOCUMENTS 4,019,649 A * 4/1977 Simon
4,921,133 A * 5/1990 Roeser ..... 222/63
6,209,568 B1 * 4/2001 Guarneri ..... 137/209
6,453,584 B1 * 9/2002 Buckner ..... 37/323

* cited by examiner

*Primary Examiner*—Christopher J. Novosad

(57) ABSTRACT

A vacuum boring and mud recovery method comprising a vacuum container, a vacuum producing device to create a vacuum within said container, a conduit to vacuum solid particles and liquids into the vacuum container and a dispensing device to dispense the liquid or solid particles from the vacuum container without eliminating the vacuum environment within the vacuum container. Vacuum container contents are stored within the container while simultaneously dispensing the solid particles and or liquids. The vacuum container method may also have a separating device disposed within it to separate solids and liquids by category. The vacuum container method is a continuous operation vacuum container, which can simultaneously fill, store and dispense solid particles and liquids with the added ability to simultaneously separate the solids and or liquids before they are dispensed from the vacuum container. This is accomplished without eliminating the vacuum environment within the vacuum container. The vacuum container method can also include an articulated powered vacuum conduit boom, a vacuum conduit tractor, purification means, articulated powered jetter conduit boom, or fixed angle tank and attached liquid storage tank.

16 Claims, 8 Drawing Sheets

VACUUM BORING AND MUD RECOVERY SYSTEM

This application is a CIP of 09/722,797, filed Nov. 27, 2000, now U.S. Pat. No. 6,453,584, which claims benefit of 60/363,058 filed Mar. 11, 2002 and claims benefit of 60/384,719 filed Jun. 03, 2002.

BACKGROUND OF THE INVENTION

1. Field of the Invention

The present invention relates to a vacuum boring and mud recovery method comprising a device which will create a vacuum condition within a container, a conduit to transport a liquid and or solid particles into the vacuum container, a dispensing device to dispense a liquid or a solid from the vacuum container without eliminating the vacuum environment within the vacuum container, and said vacuum container having the ability to fill, store and dispense its contents simultaneously. Said vacuum container further comprises a means to separate a liquid and solid particles. Articulated powered boom arms position the vacuum conduit or jetter conduit as desired. Fixed angle vacuum container dispense unprocessed debris by gravity. Liquid storage containers serve as both support for vacuum container and sides to liquid container.

2. Description of the Related Art

Current state of the art vacuum boring and mud recovery systems have a vacuum container having the ability to be filled and store liquid and solid particles. After filling said vacuum container to a predetermined capacity, the vacuum producing device must be discontinued, the filling must discontinue, the vacuum environment within the vacuum container is eliminated, the container opened and the contents dumped out. After the container is emptied, the vacuum producing device may be restarted and the filling and storing may restart. Currently, vacuum containers capable of vacuuming mud and boring earth are operated as a batch process.

The primary objective of the present invention is to provide a vacuum container method having a vacuum capable of boring and mud recovery and provide simultaneously, vacuum fill, store and dispense.

It is yet another objective of the invention to provide a means of separating the stored contents by predetermined category and dispensing them without stopping the vacuum fill and store operation or eliminating the vacuum environment within the vacuum container.

It is yet another objective of the present invention to provide an articulated powered vacuum conduit boom to allow an operator to remotely move and control the location of the suction end of the vacuum conduit and the vacuum conduit have sufficient structural strength for digging and operating attachments.

It is yet another objective of the present invention to provide an articulated powered jetter conduit boom to allow an operator to remotely move and control the location of the jetter and jetter liquid supply conduit.

It is yet another objective of the present invention to provide purification, seperation of hydrocarbons and sterilization of the vacuumed contents.

It is yet another objective of the present invention to mount the vacuum container at a fixed angle on a mobile platform so as to be able to open the exit door and empty the container by gravity.

SUMMARY OF THE INVENTION

The above described objectives and others are met by a vacuum container equipped with a vacuum producing device, a filling conduit and a dispensing method having the means to dispense a liquid or solid particles from the vacuum container without eliminating the vacuum environment within the vacuum container. The dispensing method can include a pump, a screw, a venturi or a series of valves.

A separating method can be added within the vacuum container, which has the ability to separate the liquid and solid particles by predetermined category. The separating method can include a filter, a stationary screen, a vibrating screen, a centrifuge, a hydro cyclone or a combination thereof.

At least one or more dispensing devices may be attached to the vacuum container.

DETAILED DESCRIPTION OF THE PREFERRED EMBODIMENTS

Using the drawings, the preferred embodiments of the present invention will now be explained.

Figure 1:
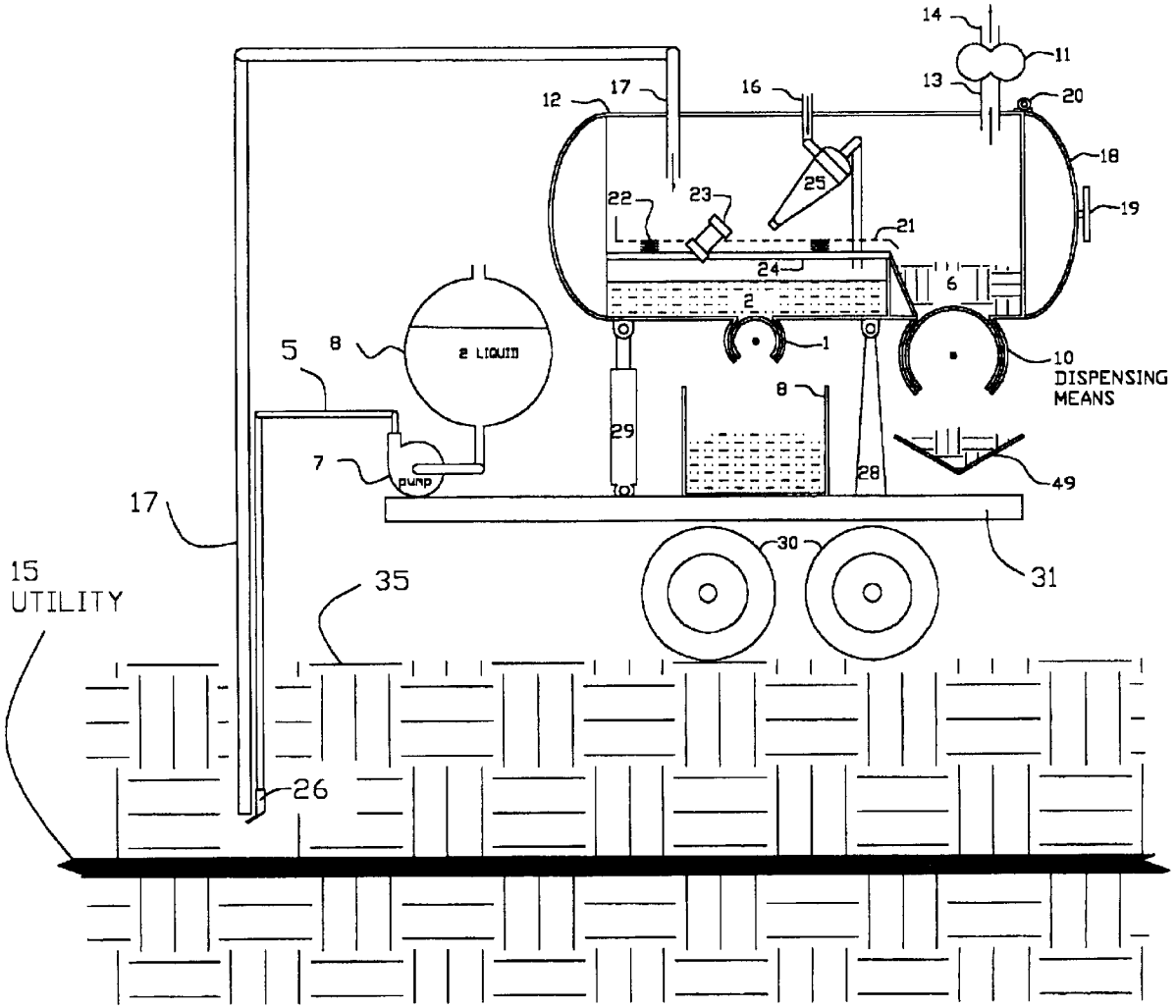
FIG. 1 shows a vacuum container according to a first embodiment of the invention having both liquid and solid dispensers and means disposed within the container to separate liquids from solids.

FIG. 1 shows the first embodiment of the invention, being one example of various possible arrangements of apparatus within a vacuum container 12 for the purpose of accomplishing a method of separating solids 6 or liquids 2 by predetermined category and then dispensing said solids 6 or liquids 2 using a dispensing means 1 without eliminating the vacuum environment within the vacuum container 12. In FIG. 1, the apparatus of the present invention include a vacuum container 12, a vacuum producing means 11, a conduit 13 to allow air to move from vacuum container 12 to vacuum producing means 11, a conduit 14 dispenses air from the vacuum producing means 11. Vacuum container 12 has an access door 18 having a hinge 20 and a latching means 19. Solids 6 or liquids 2 are vacuumed into vacuum container 12 by means of a vacuum conduit 17. In FIG. 1, the ground 35 is earthen dirt. Liquid 2, which has been stored in container 8, is pumped by pump 7 through pump discharge conduit 5 to a spray nozzle 26. The pressurized liquid 2 dislodges and emulsifies the ground 35 so it becomes vacuum able. The vacuum able ground 35 and liquid 2 are vacuumed through conduit 17 and into vacuum container 12. The solids 6 and liquids 2 fall onto a screen 21 which is vibrated by vibrator 23. Screen 21 is mounted on springs 22 which are supported by support means 24. Liquid 2 passes through screen 21 and is dispensed from the vacuum container 12 by means of a liquid dispenser means 1 which is shown as a rotary void style in this example. The solids 6 which are too large to pass through the vibrating screen 21 are vibrated to a solids dispensing means 10 which in this example is a rotary void style dispenser. The solids 6 are dispensed into solids conveyor 49. The vacuum container 12 is supported by a pivot arm 28 and a cylinder 29, which may be extended to dump contents out of container access door 18. The above system is mounted on a mobile platform 32 with wheels 30. FIG. 1 is shown excavating ground 35 in order to locate a utility 15 without doing damage to said utility 15.

Figure 2:
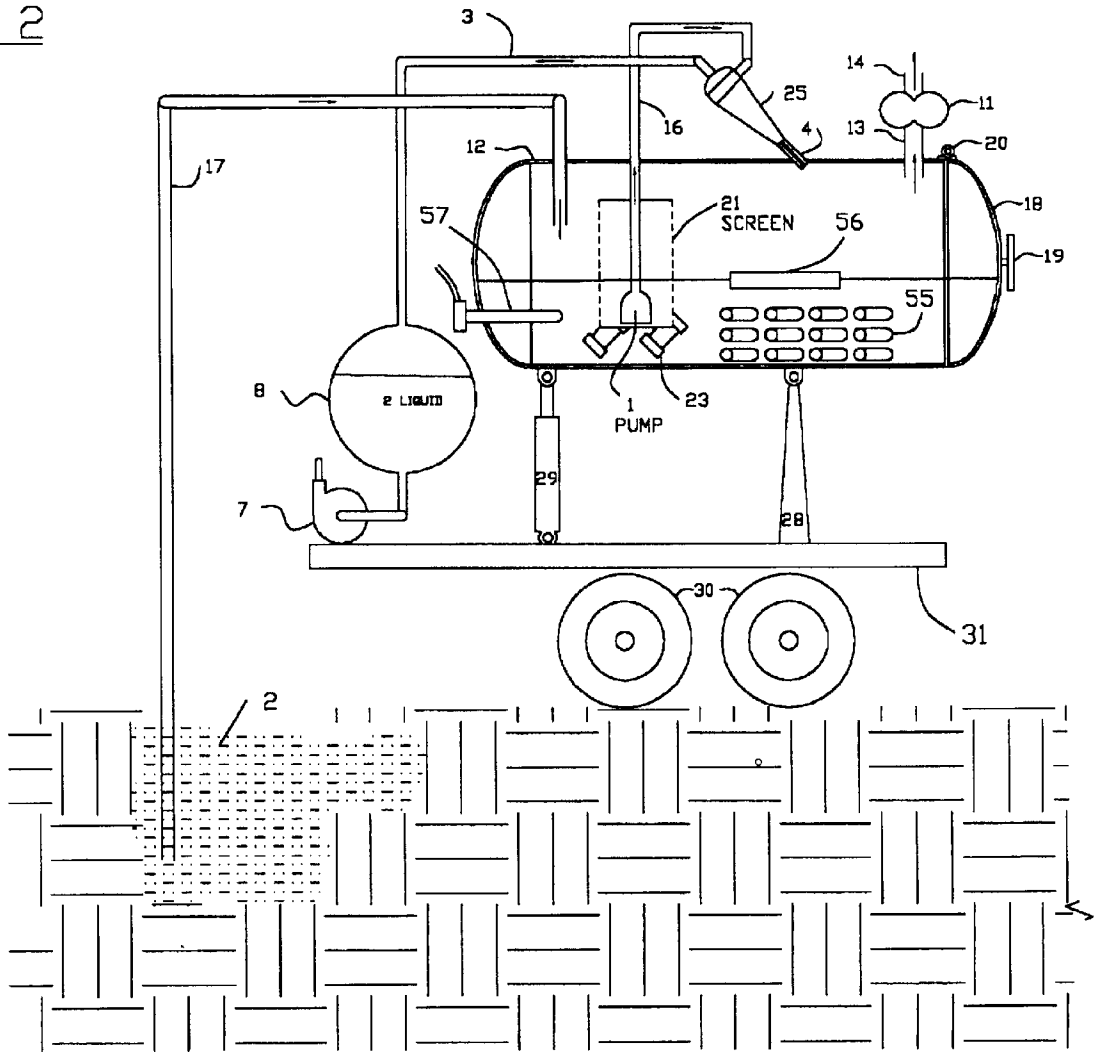
FIG. 2 shows a side elevation of a vacuum container according to a second embodiment of the invention using a screen cylinder to separate liquids from solids and having a pump dispenser disposed within the screen and having a vibrator attached to the screen. Purification means are disposed within the vacuum container to remove contaminants from the liquids or solids. Purification means 55, hydrocarbon absorbing means 56 and sterilization means 57 are shown disposed within the vacuum container although they can be attached to the container or conduits. Purification, hydrocarbon absorbs ion or sterilization means may consist of but not be limited to zealite, ozone or activated carbon or ultra violet light or phasing or ultra sonic or chlorine or peat or diatomasious earth.
Figure 3:
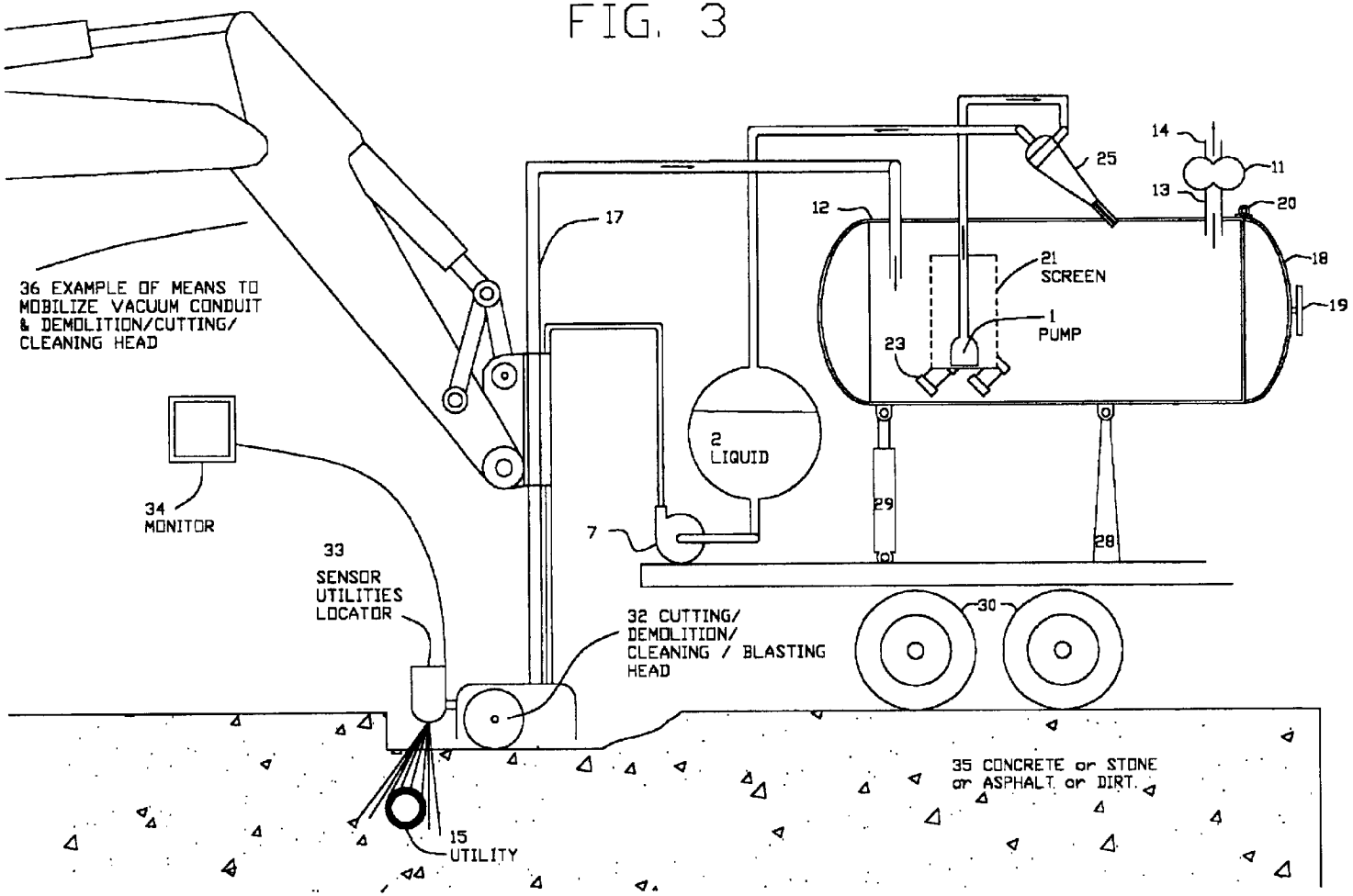
FIG. 3 shows a vacuum container and liquid dispenser according to the second embodiment of the invention using a powered boom to articulate the vacuum conduit with vacuum attachment and sensor.

In a second embodiment of the invention shown in FIGS. 2 and 3, the screen 21 is formed in the shape of a cylinder. The solids 6 and liquids 2 which are vacuumed through conduit 17, are deposited into vacuum container 12 around the vibrated screen well 21. The solids 6 which cannot pass through the screen well 21, remain in the vacuum container 12 to be dumped out through access door 18 when it is opened and cylinder 29 is extended. Liquid 2 passes through screen 21 thus dewatering the solids 6 which remain in vacuum container 12. Liquid 2, which passes through screen 21, is dispensed from vacuum container 12 by means of liquid dispenser 1, which in this example is a pump. The liquid 2 passes through conduit 16 and into hydro cyclone 25 where the solids 6 and liquid 2 separation is further refined. The solids 6 are discharged through conduit 3 which discharges into a liquid 2 storage container 8 thus providing a method to reclaim and recycle vacuumed liquids 2.

FIG. 3 has the added features of a powered mobile boom 36 to articulate the movement of vacuum conduit 17 and vacuum conduit attachments 32 which may consist of cutters, demolition means, surface grinders, cleaners, air jets, water jets, scoops, etc. Utility location sensors 33 with monitor/controller means 34 are shown to assist in locating and accessing a utility 15 buried under ground 35 which may consist of dirt, stone, asphalt, concrete or a combination there of.

Figure 4:
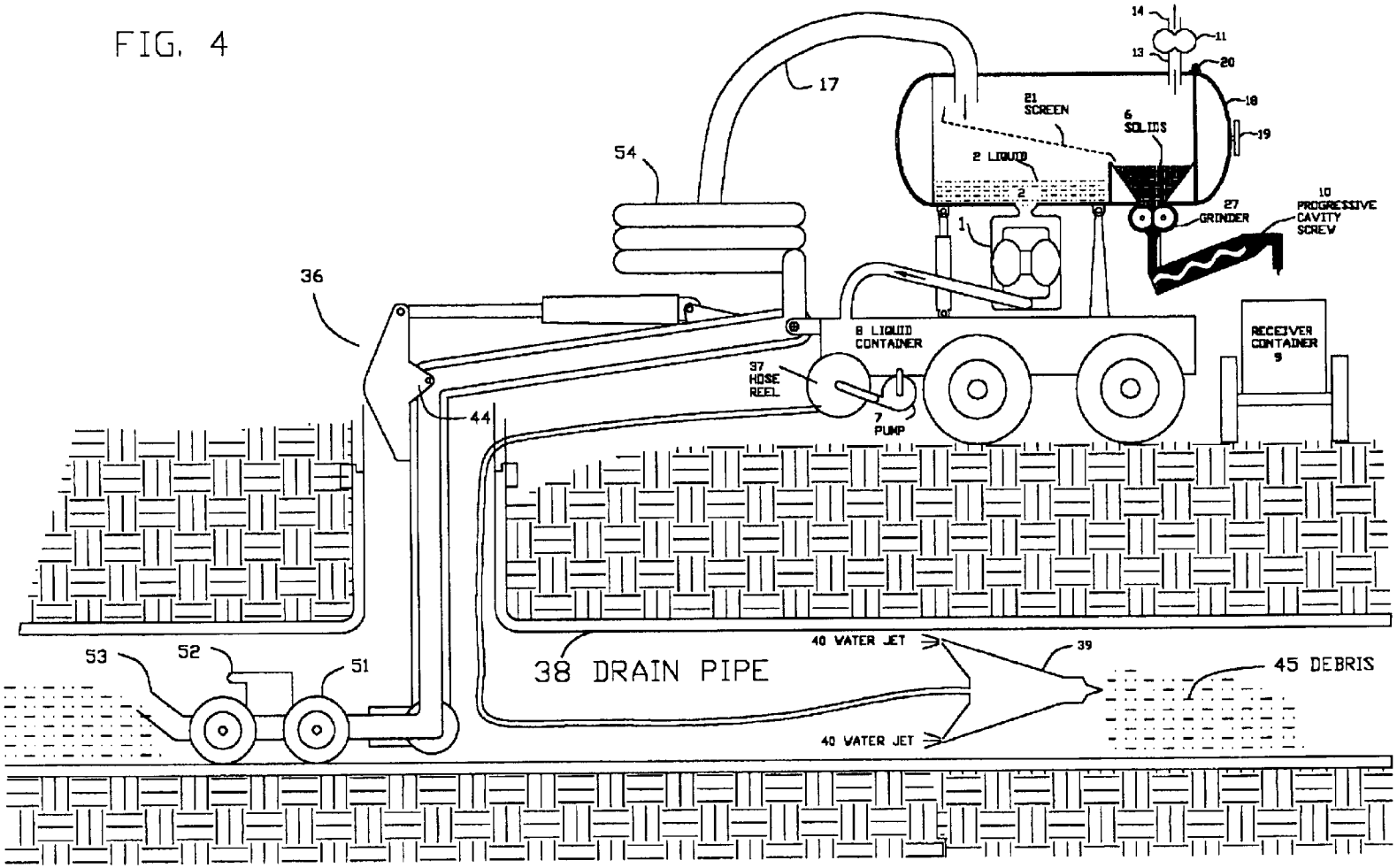
FIG. 4 shows a vacuum container with liquid and solid dispensers according to a third embodiment of the invention using a vacuum boom to reach into a drain pipe using a vacuum conduit tractor to vacuum debris. A jetter is also shown loosening debris to be vacuumed.

In a third embodiment of the invention shown in FIG. 4, the solids 6 are passed through a solids grinder 27 before being dispensed by a solids dispenser 10 which in this example is a progressive cavity screw. The dispensed solids are collected in solids receiver container 9 and then hauled off. The liquids 2 is shown being dispensed by liquid dispenser means 1, which in this example is a diaphragm pump. The recycled liquid 2 is pumped through hose reel 37 by transfer pump 7 to a water jetter 9 thus cleaning drain pipe 38 with recycled water as it moves.

The recycled jetter 39 liquid 2 along with solids 6 washed from drain pipe 38 are vacuumed up by the vacuum conduit 17 which is shown as an articulated powered vacuum conduit boom 36. The articulated powered boom also has means to place the jetter 39 into location down a manhole 59 and into a drainage conduit 38 and dispense the jetter conduit 58. In this example, cylinder 41 is used to articulate the vacuum conduit boom 36 and jetter 39. Vacuum boom structure 44 allows the vacuum conduit 17 to be rigid enough to move, support weight and force in order to articulate and operate attachments such as the vacuum conduit tractor 51 which is articulated into a starting position by the vacuum conduit boom 36. Vacuum conduit tractor 51 then moves vacuum conduit 17 to debris 45 to be vacuumed. Vacuum hose reel 54 unreels and retracts vacuum hose 17 as needed. Vacuum conduit tractor 51 can have a sensor controller means 52 attached so as to monitor and control the vacuuming process. Vacuum conduit tractor 51 can also be fitted with an articulating suction head means 53 which allows the vacuum conduit tractor to access debris 45 in multiple degrees. Although the articulating vacuum conduit boom 36 is shown vacuuming debris from a drain pipe, said vacuum conduit boom 36 works equally well vacuuming substances from railcars, barges, tankers, silos, or shaving and dung from the barn and stables.

Figure 5:
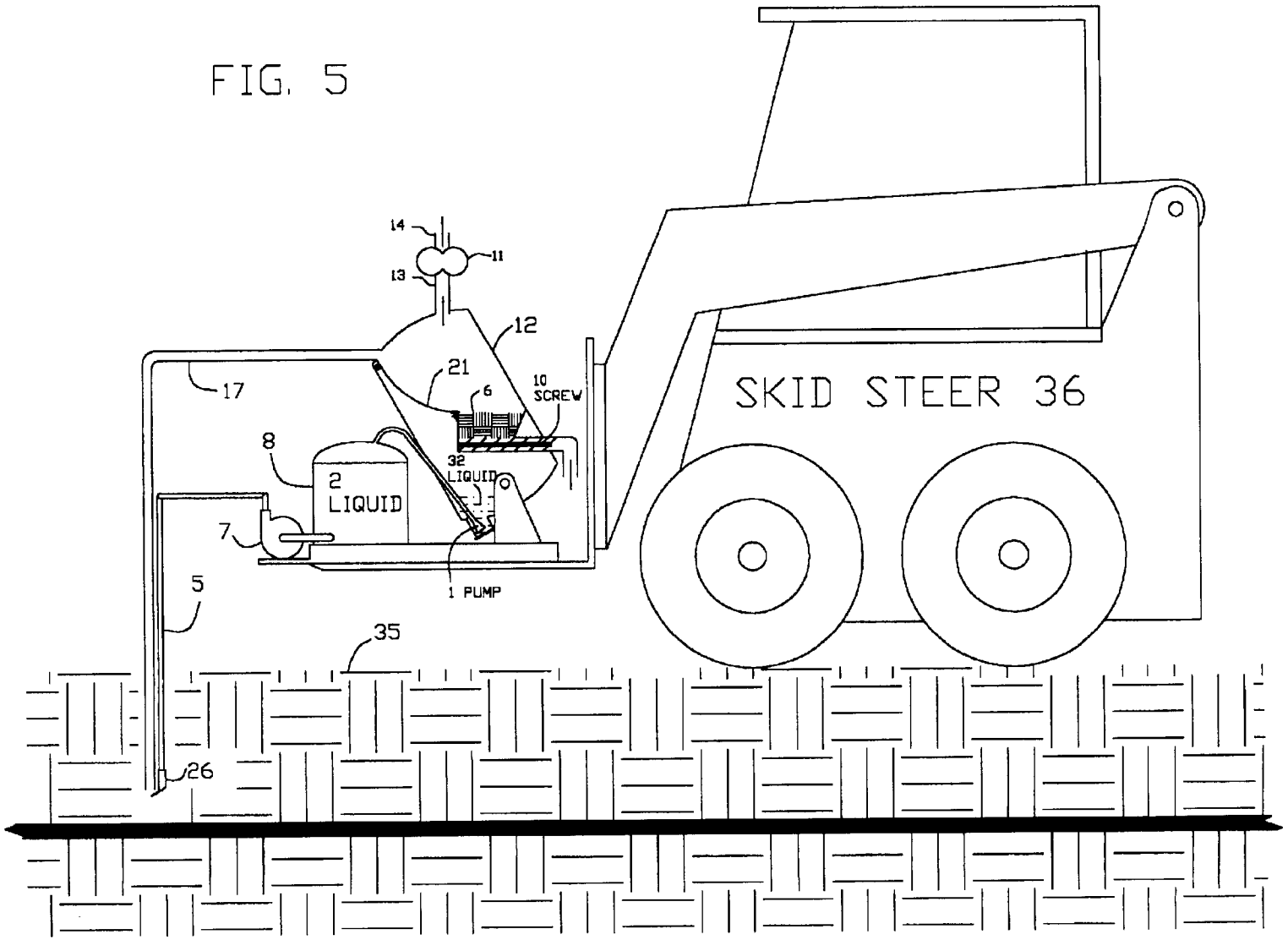
FIG. 5 shows a vacuum container with both solids and liquid dispensers according to a fourth embodiment of the invention mounted on a skid steer using a transfer pump to pump the recycled liquid from the liquid storage to the spray head. The vacuum container is shown mounted on an angle.
Figure 6:
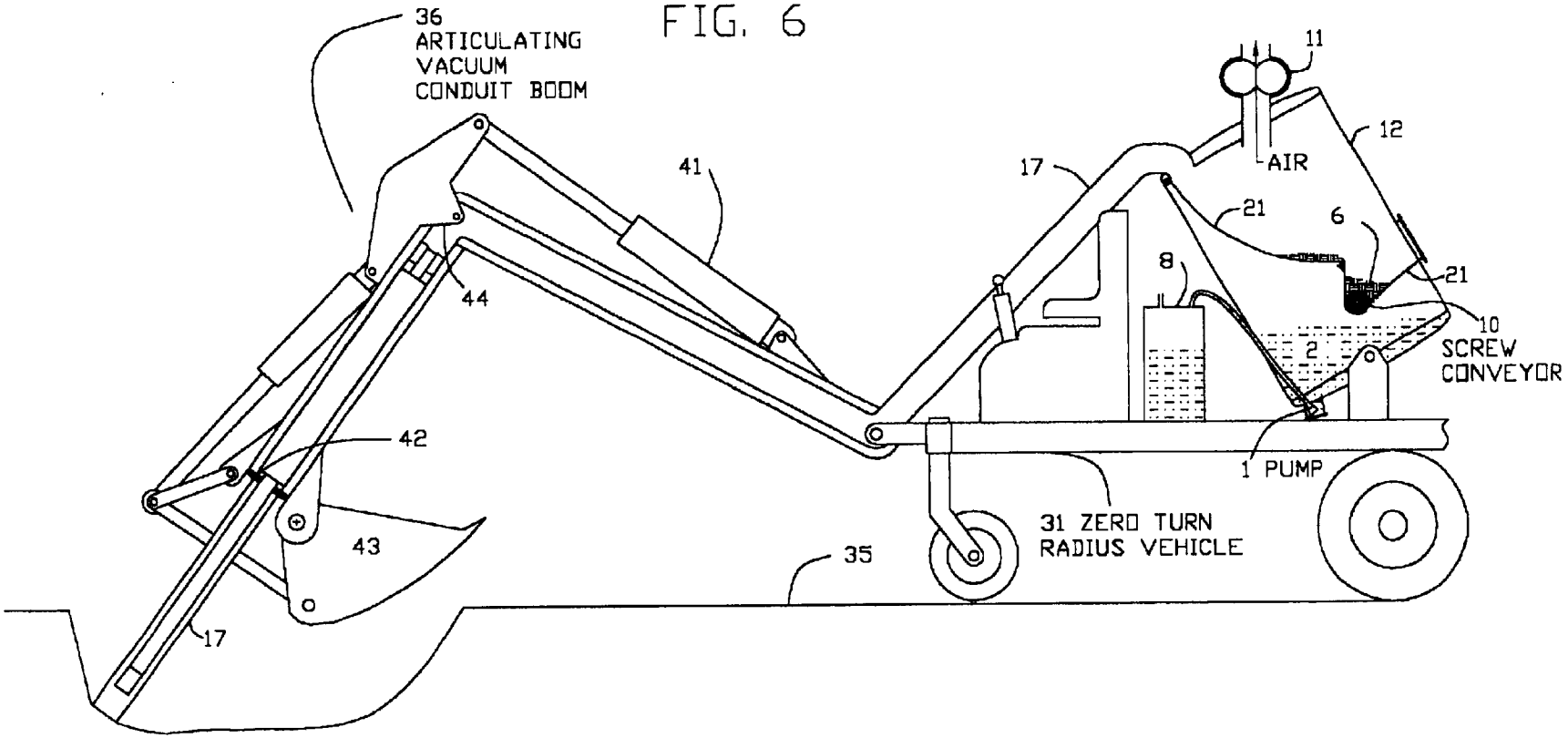
FIG. 6 shows a vacuum according to the fourth embodiment of the invention mounted on a zero turn radius vehicle using a powered articulating vacuum conduit boom with telescoping conduit and bucket.

In a fourth embodiment of the invention shown in FIG. 5, 6 and the container 12 is inclined having an inclined screen 21, which continues as a portion of the solids dispenser 10 hopper. In this example, the solids dispenser 10 is in the form of a screw conveyor. Liquid 2, which passes through the screen 21, is dispensed by liquid dispenser 1, which in this embodiment is shown as a pump. In FIG. 5, the system is mounted on a skid steer example of a mobile platform 3. A forklift, track vehicle, truck, backhoe or track hoe may be used as well. In FIG. 6, the vacuum container 12, with its components, is mounted on a mobile platform 31 shown in this embodiment as a zero turn radius vehicle. An articulated powered vacuum conduit boom 36 is also mounted to the mobile platform 31.

The articulated powered vacuum conduit boom 36 has the added means of a telescoping vacuum conduit 42 which may be retracted to allow use of a bucket 43 for digging.

Figure 8:
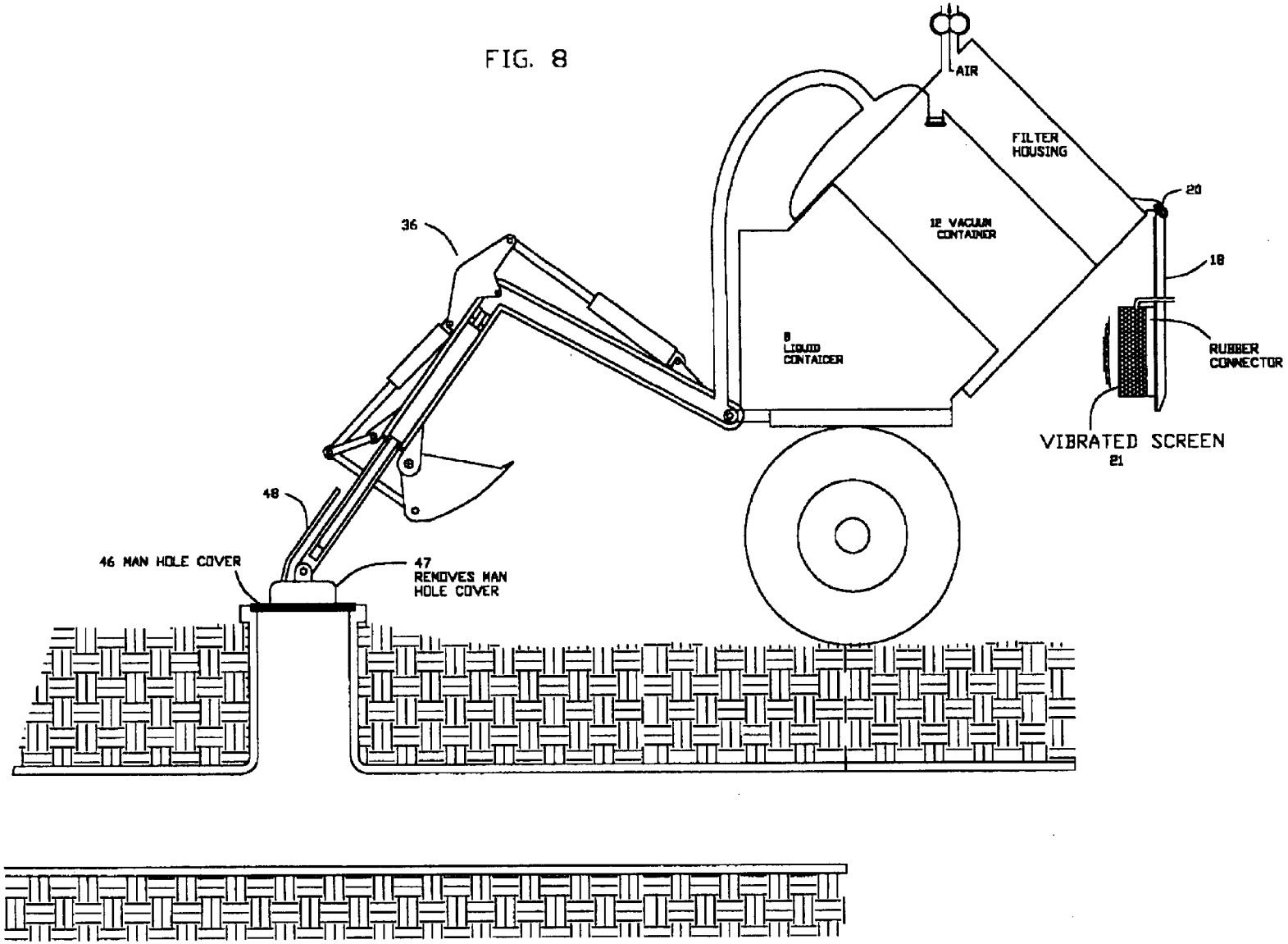
FIG. 8 shows a vacuum container according to the 5th embodiment of the invention using a powered articulating vacuum boom with a manhole cover removal attachment.

FIG. 8 shows a manhole cover removal attachment 47 mounted to the articulated powered vacuum conduit boom 36. A manhole cover 46 is being removed. A conduit 48 supplies power to the manhole cover removal attachment means 47. The manhole cover removal attachment means 47 may be an electro magnet, a suction cup or a mechanical attachment means. FIG. 8 represents a 5th embodiment of the vacuum container 2 showing the vacuum container 2 mounted in at a fixed angle on a mobile platform 31. The fixed angle is sufficient to allow the contents of the vacuum container to be removed by gravity when the door 18 is opened. The vacuum container 2 mounting support may also serve as sides for an attached liquid storage container 8.

Figure 7:
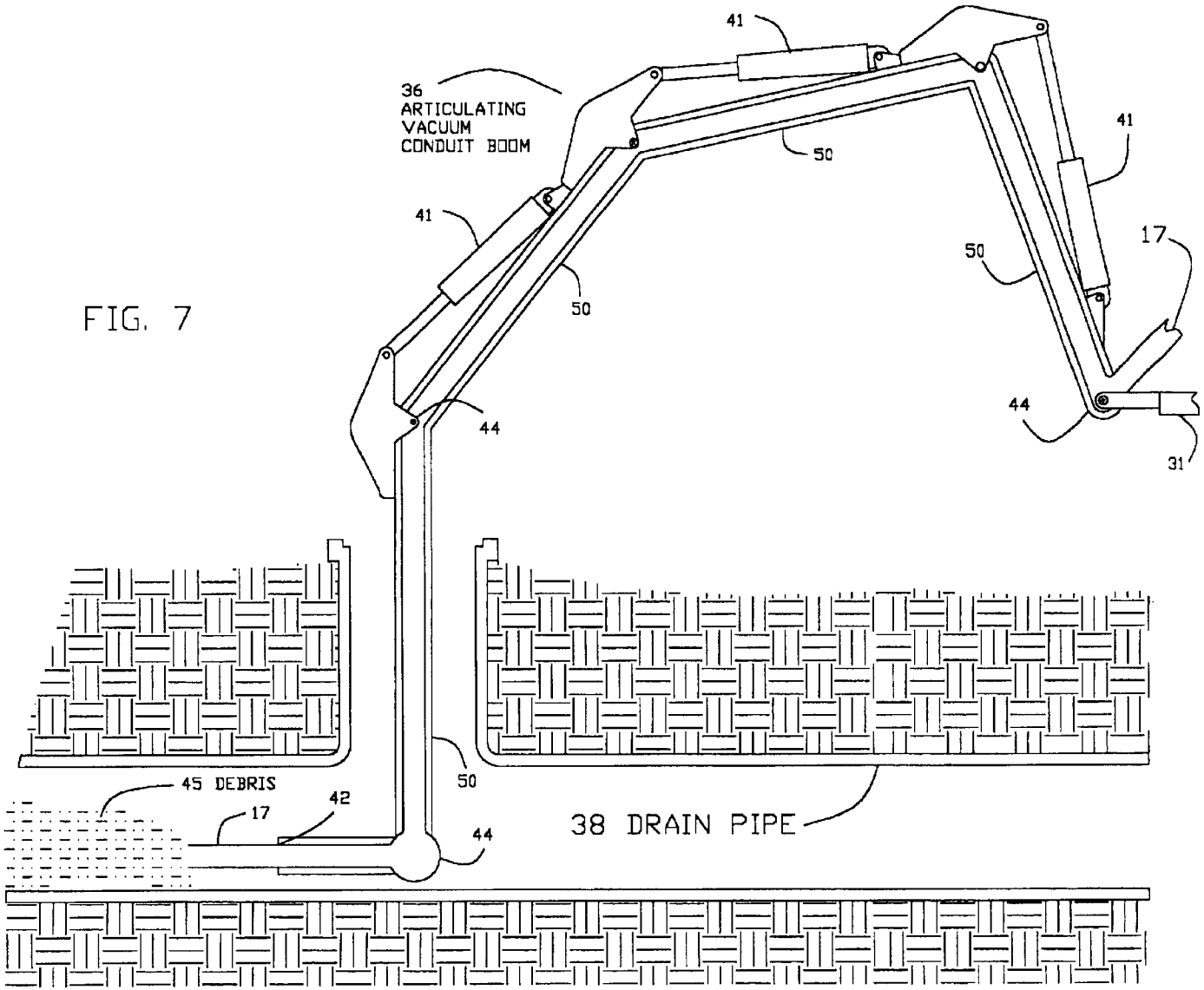
FIG. 7 shows an articulating jetter boom with multiple sections reaching into a drainage pipe to vacuum debris from the drainage pipe. A telescoping means is used to assist.

FIG. 7 shows an articulated powered jetter boom 60 having multiple boom sections 50 attached to a mobile platform 31. The boom 60 is shown loosening debris 45 from a drain pipe 38 Rotary structural support means 44 provide swivel and rotating means. It is recognized that while each of the figures show different types of vacuum methods, vacuum booms, vacuum containers with different types of solid or liquid seperation and dispensing, the various apparatuses are interchangeable and can replace one another. Further more, although some of the articulated powered vacuum conduit booms are shown with vacuum containers having liquid or solid dispensers, it is recognized that the articulated powered vacuum conduit boom and its attachment means can be used alone or in conjunction with any type of vacuum system.

The preceding description has been presented only to illustrate and describe the invention. It is not intended to be exhaustive or to limit the invention to any precise form disclosed. Many modifications and variations are possible in light of the above teaching.

What is claimed is:

1. A method of boring in dirt, mud recovery and surface cleaning which comprises the steps of: providing a vacuum container, said vacuum container having a vacuum producing means to create a vacuum within said container, providing a conduit to vacuum liquid or solid particles into said vacuum container, providing a means to allow a gas to go through said vacuum container while leaving said liquid or solid particles within said vacuum container and providing a dispensing means to dispense said liquid or solid particles from said vacuum container without eliminating said vacuum within said vacuum container, said solids and liquids are separated by an additional step of providing a separator means disposed within said vacuum, and said separator is chosen from one or more of a stationary screen, a filter, a vibrator, a vibrating screen, a hydrocyclone and a centrifuge.

2. The method of claim 1, wherein said vacuum container comprises the additional steps of providing one or more dispensing means.

3. The method of claim 1, wherein said step of providing said dispensing means is chosen from one or more of a centrifugal pump, a diaphragm pump, a venture, and a progressive cavity pump.

4. A vacuum container method according to claim 1, wherein said step of providing said dispensing means is chosen from one or more of a screw conveyor, a series of valves, a rotary air lock and a grinder.

5. A vacuum container method according to claim 1, wherein said vacuum container comprises the additional step of providing one or more means of separating solids from liquids.

6. A vacuum container method according to claim 1, wherein said vacuum container comprises an additional step of providing a purification means disposed within said vacuum.

7. A vacuum container method according to claim 1, wherein said vacuum container comprises an additional step of providing a sterilization means disposed within said vacuum.

8. A vacuum container method according to claim 1, wherein said vacuum container comprises an additional step, of providing a hydrocarbon separation means disposed within said vacuum.

9. A vacuum container method according to claim 1, wherein said vacuum container comprises an additional step of providing a purification and sterilization means disposed within said vacuum container and said purification and sterilization means is chosen from one or more of an ultra violet light, ozone injection, zealite, activated carbon, hydrocarbon absorbing means, phasing, ultra sonic sound, chlorine, peat, diatamatious earth and antibacterial element.

10. A vacuum container method according to claim 1, with an additional step wherein said liquid is made available for reuse.

11. A vacuum container method according to claim 1, with an additional step wherein said liquid is screened, pumped through a hydrocyclone, and reused to supply liquid to a pressure pump and jetter operation.

12. A vacuum container method according to claim 1, with an additional step wherein said solids are screened, dispensed out of said vacuum container and conveyed to a point for disposal or reuse.

13. A vacuum container method according to claim 1, wherein said vacuum container comprises an additional step of having an articulated powered vacuum suction conduit boom with one or more articulated arms.

14. A vacuum container method according to claim 1, wherein said vacuum container comprises an additional step of having an articulated powered vacuum suction conduit boom with one or more articulated arms, a retractable telescoping suction conduit section and a back hoe style excavation bucket.

15. A vacuum container method according to claim 1, wherein said vacuum container comprises an additional step of having an articulated powered vacuum suction conduit and pressurized liquid conduit boom with one or more articulated arms.

16. A vacuum container method according to claim 1, wherein said vacuum container comprises an additional step of having an articulated powered vacuum suction conduit boom with one or more articulated arms with suction end attachments chosen from one or more of a directional rotary swivel means to dispense suction conduit into a lateral drainage line, a directional rotary swivel means to dispense a pressurized liquid conduit into a lateral line, a powered tractor to pull a suction conduit through a lateral line, a sensor means to monitor or control vacuuming, a sensor to locate utilities, a magnetic and suction and mechanical man hole cover removal means, vibrator, cutter, rotary brush cleaner, high pressure liquid discharge nozzle, high pressure liquid discharge jetter nozzle, back hoe style excavation bucket, telescoping vacuum conduit and hose heel.

* * * * *